US006973955B2

(12) United States Patent
Tingey et al.

(10) Patent No.: US 6,973,955 B2
(45) Date of Patent: Dec. 13, 2005

(54) HEATED TROUGH FOR MOLTEN METAL

(75) Inventors: John S. Tingey, Rathdrum, ID (US); David A. Salee, Spokane, WA (US); Wade Lee Bowles, Spokane, WA (US)

(73) Assignee: Novelis Inc., Toronto (CA)

( * ) Notice: Subject to any disclaimer, the term of this patent is extended or adjusted under 35 U.S.C. 154(b) by 0 days.

(21) Appl. No.: 10/735,075

(22) Filed: Dec. 11, 2003

(65) Prior Publication Data

US 2005/0126738 A1 Jun. 16, 2005

(51) Int. Cl.[7] ..... B22D 1/00; B22D 35/00; B22D 41/00

(52) U.S. Cl. ..... 164/133; 164/136; 164/335; 266/196; 266/200; 266/231; 266/236; 266/242; 266/280

(58) Field of Search ..... 164/136, 133, 164/335; 266/196, 200, 231, 236, 242, 280

(56) References Cited

U.S. PATENT DOCUMENTS

| | | | | |
|---|---|---|---|---|
| 3,494,410 A | | 2/1970 | Birchill et al. | 164/82 |
| 4,345,743 A | | 8/1982 | Sivilotti et al. | 266/44 |
| 4,531,717 A | | 7/1985 | Hebrant | 266/166 |
| 4,556,202 A | * | 12/1985 | Yamura et al. | 266/242 |
| 4,635,706 A | | 1/1987 | Behrens | 164/500 |
| 4,993,607 A | | 2/1991 | Brun et al. | 222/590 |
| 5,126,107 A | * | 6/1992 | Darnfors | 420/584.1 |
| 5,316,071 A | | 5/1994 | Skinner et al. | 164/155.1 |
| 5,908,066 A | * | 6/1999 | Rauch | 164/133 |
| 5,913,353 A | | 6/1999 | Riley et al. | 164/113 |
| 6,257,023 B1 | * | 7/2001 | Uhm et al. | 65/537 |
| 6,444,165 B1 | * | 9/2002 | Eckert | 266/196 |

FOREIGN PATENT DOCUMENTS

| | | | |
|---|---|---|---|
| WO | WO 03/066913 | 8/2003 | C22B 21/00 |

* cited by examiner

*Primary Examiner*—Jonathan Johnson
*Assistant Examiner*—I.-H. Lin
(74) *Attorney, Agent, or Firm*—Cooper & Dunham LLP

(57) ABSTRACT

A trough is described for carrying molten metal, comprising an outer shell defined by a bottom wall and two side walls, an insulating layer filling the outer shell and a conductive U-shaped refractory trough body for carrying molten metal, the trough body being embedded in the insulating layer. At least one heating element is positioned in the insulating layer, adjacent to but spaced apart from the trough body, to provide an air gap between the heating element and the trough body.

22 Claims, 3 Drawing Sheets

HEATED TROUGH FOR MOLTEN METAL

FIELD OF THE INVENTION

The invention generally relates to apparatus for conveying molten metal, and more specifically molten aluminum in aluminum casting processes.

BACKGROUND OF THE INVENTION

In molten metal processing, troughs are generally used to convey the molten metal from the melting furnace to various process devices, such as casting moulds, analyzers, etc. Where there is ample metal flow, there is sufficient sensible heat in the molten metal to compensate for heat losses via the trough. However, in low metal flow situations, or long trough runs, some form of trough heating is required to prevent excessive metal heat loss.

U.S. Pat. No. 3,494,410 (Birchill et al) discloses a generic heated trough with provision for heating from any side, but without any detail as to how to achieve efficient thermal control.

U.S. Pat. No. 4,345,743 (Sivilotti) teaches an adiabatic tubular discharge conduit including a refractory lining for containing the molten metal and encompassed by heater elements.

U.S. Pat. No. 6,444,165 (Eckert) dated Sep. 3, 2002, describes a heated trough having heaters embedded in the side walls or bottom, in close contact with the refractory material of the trough.

These two references both use heaters which heat by conduction. Such heaters tend to form hot spots and uneven heating due to the difficulty in ensuring good contact with the surrounding refractory. They can be difficult to maintain because of a tendency get stuck by metal impregnation or expansion of the element shell. With heaters operating by thermal contact, the temperature difference between heater and surrounding materials will be low in the case of good thermal contact, and therefore a high heater temperature is needed to achieve a good watt density and energy transfer.

U.S. Pat. No. 4,531,717 (Hebrant) discloses a covered heated trough with heaters mounted in the top cover. These heaters operate principally by radiation rather than conduction and the heat flux is dependent on a fourth power of the temperature of the heater and the surface receiving the radiation. Radiative heaters are capable of high watt densities. However, heaters radiating to the surface of a molten metal are overall inefficient because of the low emissivity of the surface.

There is a common tendency for impurities, or inclusions, to form in molten metal as it travels down the trough, which is made more serious for troughs heated from above (top-heated). These inclusions grow in the presence of atmospheric oxygen at the surface of the trough, and refractory materials from which the troughs are usually made. High temperatures provided at the molten metal surface and low metal flow rates increase this effect dramatically.

It is therefore desirable to find a trough heater arrangement that will provide even and controllable heat to the traveling molten metal, while reducing formation of inclusions.

SUMMARY OF THE INVENTION

The present invention thus provides in one embodiment, a trough for carrying molten metal, comprising an outer shell defined by a bottom wall and two side walls, an insulating layer filling the outer shell and a conductive U-shaped refractory trough body for carrying molten metal, the trough body being embedded in the insulating layer. At least one heating element is positioned in the insulating layer, adjacent to but spaced apart from the trough body, to provide an air gap between the heating element and the trough body.

In a further embodiment of the invention there is provided a method for heating molten aluminum in a trough for conveying metal wherein the trough comprises an outer shell defined by a bottom wall and two side walls, an insulating layer filling the outer shell and a conductive U-shaped refractory trough body for carrying molten metal, the trough body being embedded in the insulating layer and wherein heat is provided by one or more radiant heaters embedded in the tough lining adjacent the conductive U-shaped refractory trough but spaced apart from the trough body, to provide an air gap between the heating element and the trough body.

BRIEF DESCRIPTION OF THE DRAWINGS

The present invention will be described in conjunction with the following figures.

DETAILED DESCRIPTION OF PREFERRED EMBODIMENTS OF THE INVENTION

Figure 1:
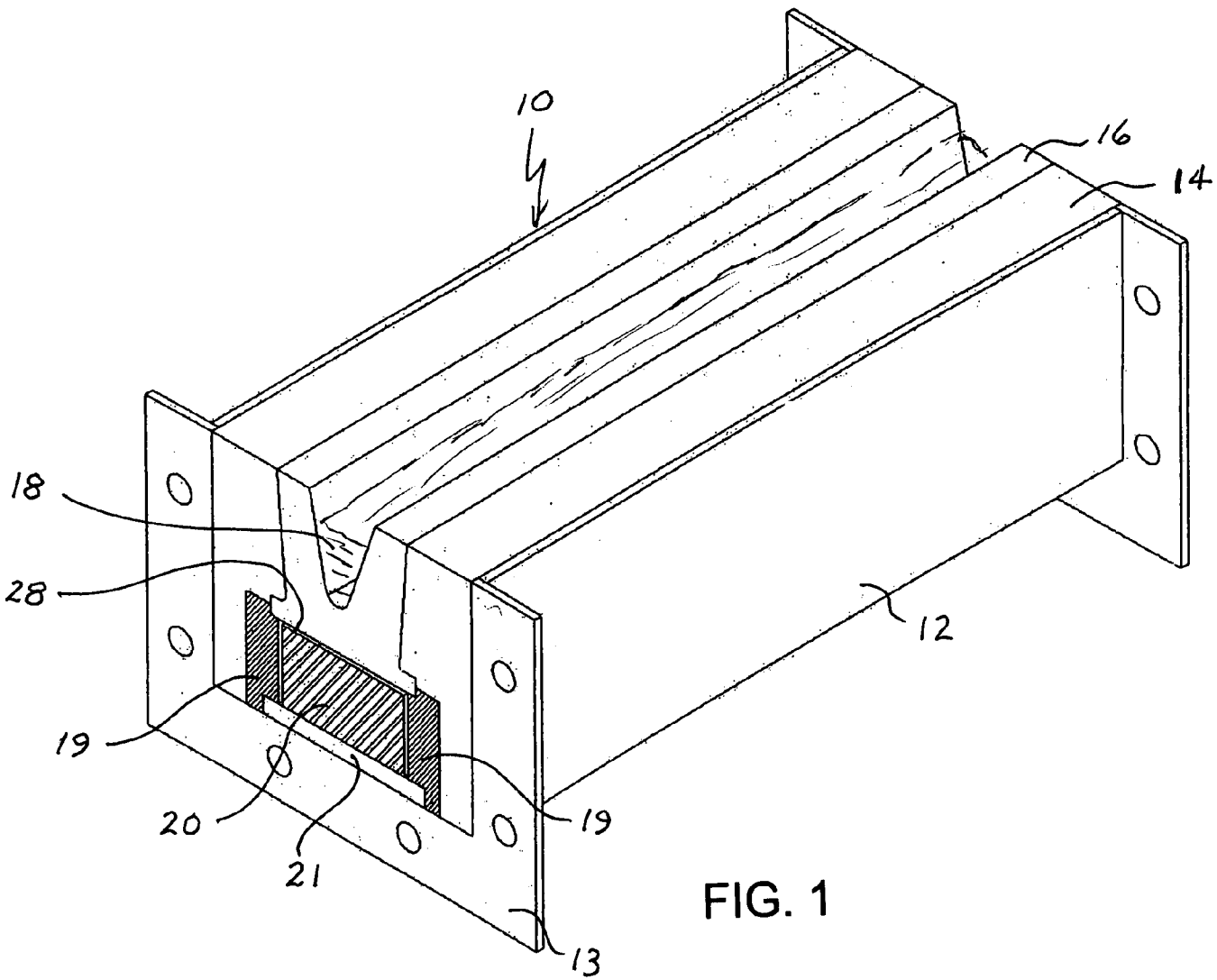
FIG. 1 is a perspective view of the heated trough of the present invention.
Figure 2:
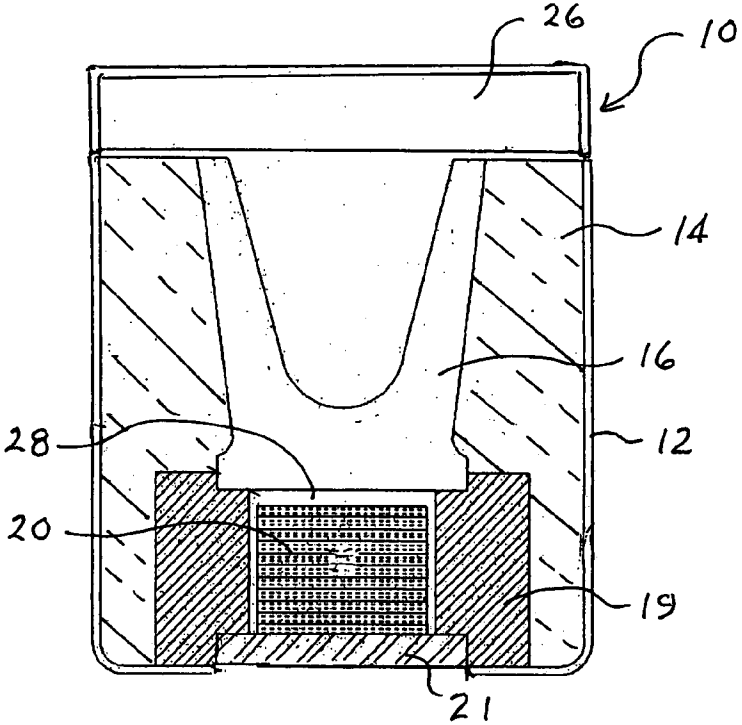
FIG. 2 is an cross-section view taken through the middle of the heated trough of FIG. 1.

FIGS. 1 and 2 show a perspective and cross-sectional view of a heated trough according to the present invention. With reference to these figures, trough 10 comprises an outer shell 12, which can be made of steel or other suitable materials well known in the art, and end plates 13 suitable for connecting trough sections together or for attaching to other parts of the metal handling system. Inside the outer shell 12 is a layer of insulation 14 and resting within the insulation 14 is a U-shaped trough body 16 for carrying molten metal 18. The trough body 16 is generally highly conductive and resistant to corrosion from the molten metal and can be made of a dense refractory such as, for example, silicon carbide or graphite. The layer of insulation can consist of a single type of insulation, or may be graded from inner to outer surface with different types in sublayers. The insulation is typically an alumino-silicate refractory fibrous or pourable insulating refractory.

The trough body is supported within the surrounding insulation 14 on piers 19 manufactured from a refractory material, e.g. calcium silicate (wollastonite) refractory board.

A heating element 20 is positioned in the layer of insulation 14 and between the piers 19, adjacent to but spaced apart from the trough body 16, to provide an air gap 28. The air gap 28 allows for radiative heat transfer between the heating element 20 and the trough body 16. As the trough body is highly conductive, the heat balance is such that there will be a significant temperature difference between the heater and the portion of the trough body facing the heater but spaced apart from it. This allows for efficient operation of the heaters and a high heat flux even with heater temperatures lower than those used in conductive heating situation. The air gap 28 is sufficient to prevent either intermittent or accidental thermal contact between heater and trough body and therefore eliminates localized heat transfer by conduction and uneven heat and hot spots. The maximum size of the air gap 28 is not critical, and in one embodiment, a tapered gap may be used, with a larger gap width to allow for a larger heater surface area compared to the facing trough area, with resulting greater effective heat transfer. To avoid conductive heat losses to the wollastonite piers 19, the air gap is also continued between the sides of the heater elements and the piers. Although referred to as a single heating element, it is understood that the term "heating element" as used herein also includes more than one element. The heating elements are typical radiative heaters as supplied for example by Watlow.

A further closure board 21 of refractory material, such as wollastonite, is provided underneath the heater 20. This board can be removed to allow the heaters to be removed easily for servicing or replacement without dismantling the trough.

The trough body material should have a high absorptivity to radiation or be coated with a conductive, high absorptivity coating to maximize the radiative heat transfer. Silicon carbide and graphite trough materials have acceptable absorptivity for these applications.

The air gap 28 between the at least one heating element and the trough body is preferably at least 0.5 cm. to avoid accidental thermal contacts in use. For practical reasons of space, a maximum air gap of 1 cm is generally used.

FIG. 2 shows in addition, a further preferred embodiment where an insulating cover 26, such as any well known in the art, can be placed over the trough 10, to reduce heat loss by the molten metal. In some embodiments, provision is made for the injection of an inert gas under the insulating cover and in such cases, the cover is provided with appropriate sealing means.

Figure 3:
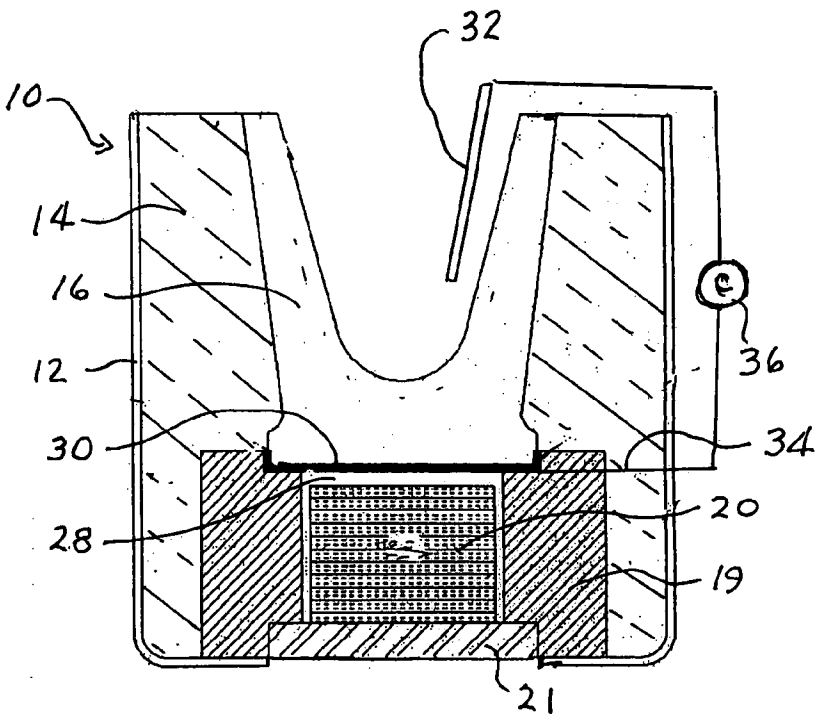
FIG. 3 is a cross-section view as in FIG. 2 showing another embodiment of the heated trough of the present invention.

In a preferred embodiment shown in FIG. 3, the trough can further comprise a metal or non-metallic metal intrusion barrier comprising, for example, a metallic or graphite screen or porous sheet 30 fitted to the outer surface of the trough body 16, adjacent the heating element 20, to serve as a metal barrier. This screen can be a metal alloy such as Fe-Ni-Cr alloy. The metal intrusion barrier should be thermally stability and non-wetting to aluminum and be efficient at passing radiative heat without losing effect. A mesh sizing of 0.5 mm by 0.5 mm is typically effective for this purpose.

A metal intrusion barrier, when manufactured from an electrically conductive metal or non-metal may be used for detection of metal leaks by providing a means to detect a change in conductivity between the barrier and the metal in the trough. Such a detector may consist of a probe 32 that is immersed in the metal in the tough and an electrical connection 34 to the metal intrusion barrier with a conductivity detector 36 connected between the two. Normally a very low conductivity will be detected, but if metal infiltration occurs, the conductivity will rise and the conductivity detector 36 will signal a fault so that corrective action can be taken.

Figure 4:
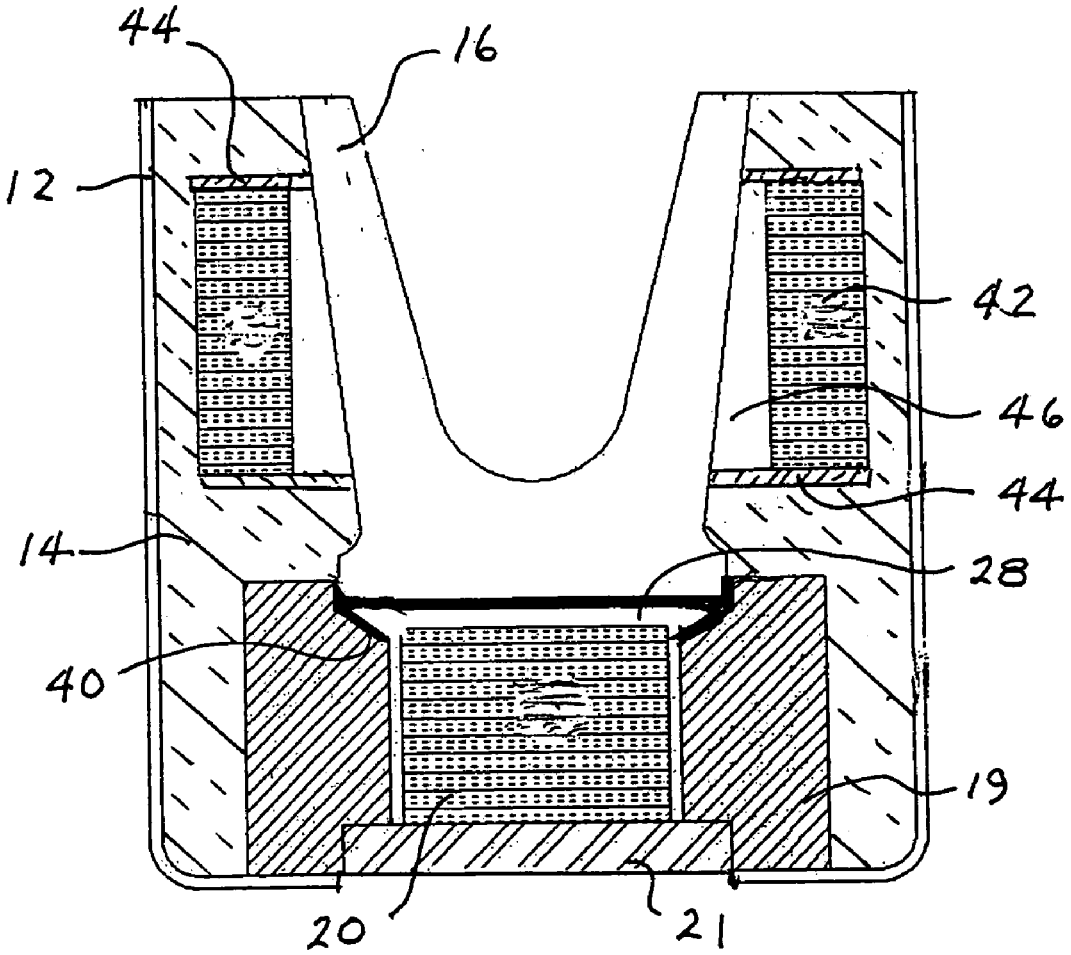
FIG. 4 is a cross-section view as in FIG. 2 showing a further embodiment of the heated trough of the present invention.

A further embodiment of the present invention is shown in FIG. 4. In this embodiment, the wollastonite piers 19 are outwardly tapered 40 so that the radiation gap 28 is outwardly tapered, allowing for a greater watt density in the heater 20 as mentioned above. FIG. 4 also shows a further embodiment where heaters 42 similar to the bottom heater 20 are mounted between wollastonite supports 44 along the sides of the trough 16. A radiation gap 46 is provided for each of these heaters, and in the design shown, this radiation gap is effectively tapered as well. It is understood that such side heaters can be used in conjunction with a bottom heater as shown, or on their own. Access plates (not shown) similar to the bottom closure board 21 may also be used in some embodiments in the side of the trough to allow easy access to the side heaters.

A suitable temperature control system, as well known in the art, can be used in conjunction with the trough 10 of the present invention. The system can comprise thermocouples placed in the one or more heating elements 20 and in sections of the trough body 16 near a top surface of the molten metal 18. A trough heater control program utilizes the output from both types of thermocouples to maintain accurate molten metal temperatures while prolonging the life of the heating element 20 by limiting heating element 20 output. One or more voltages can be used to heat and maintain the surface temperature of the molten metal in the trough body. For example, the voltages can be 220 or 110 volts.

The logic behind the heater control program uses P.I.D. closed loop control in order to maintain a tight tolerance of the molten metal temperature just prior to introduction to the casting mould. An example of a suitable temperature control system can be seen in U.S. Pat. No. 6,555,165 (Eckert), incorporated herein by reference.

What is claimed is:

1. A trough for carrying molten metal, comprising:

(a) an outer shell defined by a bottom wall and two side walls:

(b) an insulating layer filling the outer shell;

(c) a conductive refractory trough body for carrying molten metal, embedded in the insulating layer; and (d) a heating element positioned in the insulating layer, adjacent to but spaced apart from the trough body, to provide an air gap between the heating element and the trough body.

2. The trough of claim 1 wherein the air gap between the heating element and the trough body is at least 0.5 cm.

3. The trough of claim 1 wherein the air gap between the heating element and the trough body is less than 1.0 cm.

4. The trough of claim 1 wherein the heating element is positioned adjacent the bottom end of the trough.

5. The trough of claim 4 wherein heating elements are positioned adjacent side walls of trough.

6. The trough of claim 1 wherein the trough body is made of silicon carbide or graphite.

7. The trough of claim 1 further comprising a metal intrusion barrier means fitted to an outer surface of the trough body, adjacent the heating element, said metal intrusion barrier being a mesh or porous sheet.

8. The trough of claim 7 wherein the metal intrusion barrier means is made of a metal alloy or non-metal.

9. The trough of claim 7 wherein the metal alloy is an Fe-Ni-Cr alloy.

10. The trough of claim 7 wherein the non-metal is graphite.

11. The trough of claim 7 further comprising a conductivity detector connected with one connection to the meal intrusion barrier and with a second connection adapted for insertion in molten metal within the trough, the conductivity detector provided with a means to signal when the measured conductivity increases as a result of metal intrusion within the trough lining.

12. The trough of claim 1 further comprising thermocouples placed in the heating element and in the trough body adjacent the molten metal and a proportional integrating derivative closed loop control program for controlling heat output from the heating element.

13. The trough of claim 1 wherein said trough body and heating element are separated from each other only by said air gap.

14. The trough of claim 1 wherein the air gap allows for direct radiative heat transfer from the heating element to the trough body.

15. A method for heating molten metal being conveyed in a trough, said trough comprising an outer shell defined by a bottom wall and a pair of side walls, an insulating layer filling the outer shell, a conductive refractory trough body for carrying molten metal embedded in the insulting layer and a heating element positioned in the insulating layer, adjacent to but spaced apart from the trough body, to provide an air gap between the heating element and the trough, the method comprising directing heat from the heater to the trough body by radiative heat transfer across the air gap and thereby providing uniform heating of the trough body and molten metal being conveyed therein.

16. The method of claim 15 wherein the distance across the air gap is 0.5 to 1.0 cm.

17. The method of claim 15 wherein the heating element is positioned adjacent the bottom end of the trough.

18. The method of claim 15 wherein the temperature of the heating element and the trough body adjacent the molten meal are measured and utilized for controlling heat output from the heating element.

19. The method of claim 15 wherein the temperature of the heating element and the trough body adjacent the molten metal are measured and utilised for controlling heat output from the heating element.

20. The method of claim 15 wherein a metal intrusion barrier means is provided on an outer surface of the trough body adjacent the heating element and conductivity is measured between the intrusion barrier and the molten meal within the trough, with an increase in conductivity indicating metal leakage from the trough.

21. The method of claim 15 wherein, in said trough, the trough body and the heating element are separated from each other only by said air gap.

22. The method of claim 15 wherein said directing of heat causes direct radiative heat transfer from said heating element to said trough body.

* * * * *